US010806319B2

(12) United States Patent
Lee et al.

(10) Patent No.: US 10,806,319 B2
(45) Date of Patent: Oct. 20, 2020

(54) HANDLE FOR CLEANER AND DEVICE HAVING IMPROVED GRIP FEELING

(71) Applicant: LG ELECTRONICS INC., Seoul (KR)

(72) Inventors: Jinwoo Lee, Seoul (KR); Gunho Ha, Seoul (KR); Geunyong Jung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 160 days.

(21) Appl. No.: 15/393,612

(22) Filed: Dec. 29, 2016

(65) Prior Publication Data

US 2017/0188773 A1 Jul. 6, 2017

(30) Foreign Application Priority Data

Dec. 30, 2015 (KR) ..... 10-2015-0189533

(51) Int. Cl.

| | |
|---|---|
| ***A47L 9/32*** | (2006.01) |
| ***A47L 9/14*** | (2006.01) |
| ***A47L 9/10*** | (2006.01) |
| ***A47L 5/36*** | (2006.01) |
| ***A47L 9/24*** | (2006.01) |
| ***B25G 1/10*** | (2006.01) |

(52) U.S. Cl.

CPC ..... *A47L 9/327* (2013.01); *A47L 5/362* (2013.01); *A47L 9/102* (2013.01); *A47L 9/1409* (2013.01); *A47L 9/242* (2013.01); *A47L 9/32* (2013.01); *B25G 1/102* (2013.01)

(58) Field of Classification Search

None

See application file for complete search history.

(56) References Cited

U.S. PATENT DOCUMENTS

| | | | | |
|---|---|---|---|---|
| 4,524,514 A | | 6/1985 | Mallalieu et al. | |
| 4,837,892 A | * | 6/1989 | Lo | B25F 5/006 16/431 |
| 5,601,003 A | * | 2/1997 | Amtenbrink | B25G 1/105 81/177.1 |
| 5,781,956 A | * | 7/1998 | Kelsay | B25G 1/102 15/143.1 |

(Continued)

FOREIGN PATENT DOCUMENTS

| | | |
|---|---|---|
| CN | 2570373 | 9/2003 |
| CN | 2764569 | 3/2006 |

(Continued)

OTHER PUBLICATIONS

R & D Plastics, Dec. 2014, found at https://web.archive.org/web/20141215023951/http://www.rdplast.com/overmolding-sonic-welding-plastic-knife-handle.html, attached as pdf (Year: 2014).*

(Continued)

*Primary Examiner* — Brian D Keller

(74) *Attorney, Agent, or Firm* — Ked & Associates, LLP

(57) ABSTRACT

A handle for a cleaner includes two or more handle bodies that have grip bodies, respectively; and a grip cover that is formed of rubber and is insert-injection-molded to surround grip bodies that define a grip part in a state in which the respective grip bodies are connected to each other to define the grip part, wherein the grip cover covers a boundary between the grip bodies.

16 Claims, 9 Drawing Sheets

(56) References Cited

U.S. PATENT DOCUMENTS

| | | | | |
|---|---|---|---|---|
| 6,408,474 | B1 * | 6/2002 | Husted | A46B 3/12 15/143.1 |
| 8,154,313 | B1 * | 4/2012 | Cantolino | F24F 11/30 324/750.01 |
| 8,671,517 | B2 | 3/2014 | Ventress et al. | |
| 2002/0104666 | A1 * | 8/2002 | McCallops | B25F 5/02 173/168 |
| 2003/0226239 | A1 | 12/2003 | Hua | |
| 2006/0110704 | A1 | 5/2006 | Bills | |
| 2007/0251059 | A1 | 11/2007 | You | |
| 2009/0062085 | A1 * | 3/2009 | Polevoy | A63B 21/0728 482/93 |
| 2009/0129725 | A1 * | 5/2009 | Durrant | G02B 6/4201 385/14 |
| 2011/0017506 | A1 * | 1/2011 | Kao | B29C 45/14065 174/521 |
| 2011/0259161 | A1 * | 10/2011 | Liao | B25B 15/02 81/436 |
| 2013/0298411 | A1 | 11/2013 | Miyawaki | |

FOREIGN PATENT DOCUMENTS

| | | |
|---|---|---|
| CN | 2772744 | 4/2006 |
| CN | 2938193 | 8/2007 |
| CN | 202480079 | 10/2012 |
| CN | 202699047 | 1/2013 |
| CN | 103402712 | 11/2013 |
| GB | 2 478 387 | 9/2011 |
| KR | 10-2005-0063840 | 6/2005 |

OTHER PUBLICATIONS

European Search Report dated May 8, 2017 issued in Application No. 16207464.5.

Chinese Office Action dated Sep. 30, 2018 issued in CN Application No. 201611253726.1.

Chinese Notice of Allowance dated Jan. 16, 2020 issued in CN Application No. 201611253726.1.

* cited by examiner

HANDLE FOR CLEANER AND DEVICE HAVING IMPROVED GRIP FEELING

CROSS-REFERENCE TO RELATED APPLICATION(S)

This application claims priority under 35 U.S.C. 119 and 35 U.S.C. 365 to Korean Patent Application No. 10-2015-0189533 filed on Dec. 30, 2015 in Korea, the entire contents of which is hereby incorporated by reference in its entirety.

BACKGROUND

1. Field

In general, a vacuum cleaner refers to an apparatus for sucking dusts and foreign substances on a surface to be cleaned using a suction motor that is provided inside a body and then filtering the dusts and the foreign substances inside the body.

2. Background

The above-described vacuum cleaner may be classified into an upright vacuum cleaner in which a suction nozzle is connected to a body and is moved together with the body and a canister vacuum cleaner in which a suction nozzle is connected to a body through an extension tube, a handle, a hose and the like. U.S. Pat. No. 8,671,517 (registered on Mar. 18, 2014) as the related art discloses a handle for an extension tube of a vacuum cleaner.

The handle disclosed in the related art includes a handle body, a handle cover that defines a handle grip part together with the handle body and a cylindrical rotation part. The handle grip part is generally formed of an injection-molded product formed of plastic.

However, there is a problem in that when a user performs cleaning while holding the handle grip part which is an injection-molded product, the handle grip part may be hard, and thus a grip feeling may be unpleasant. The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Figure 1:
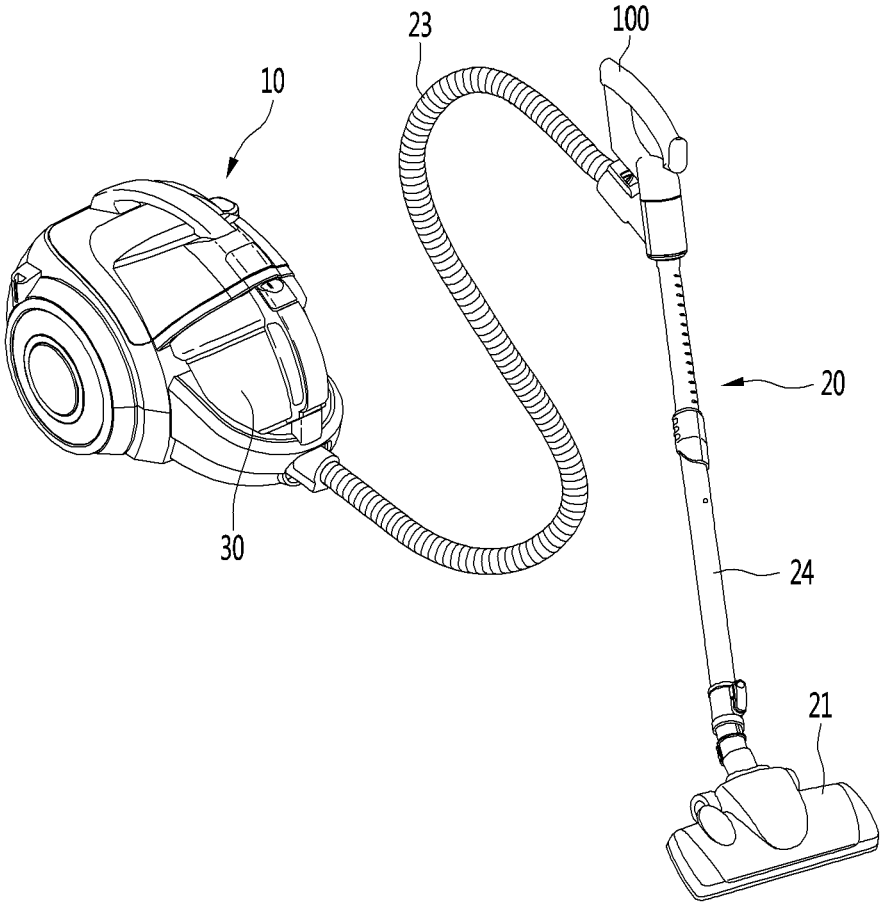
FIG. 1 is a perspective view illustrating a vacuum cleaner according to an embodiment of the present disclosure.
Figure 2:
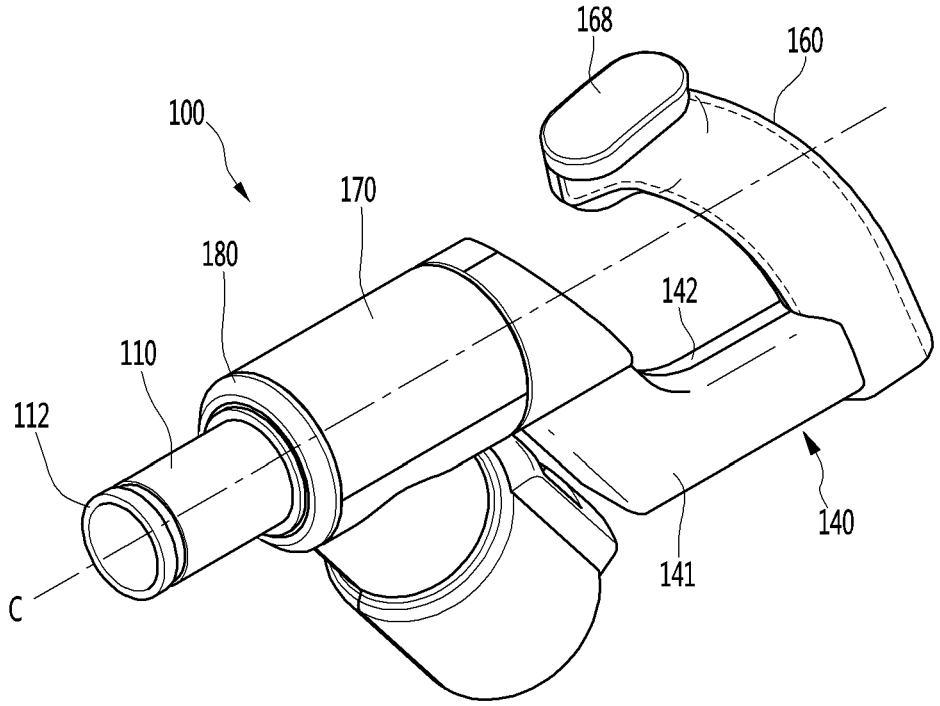
FIG. 2 is a perspective view illustrating a handle according to the embodiment of the present disclosure.
Figure 3:
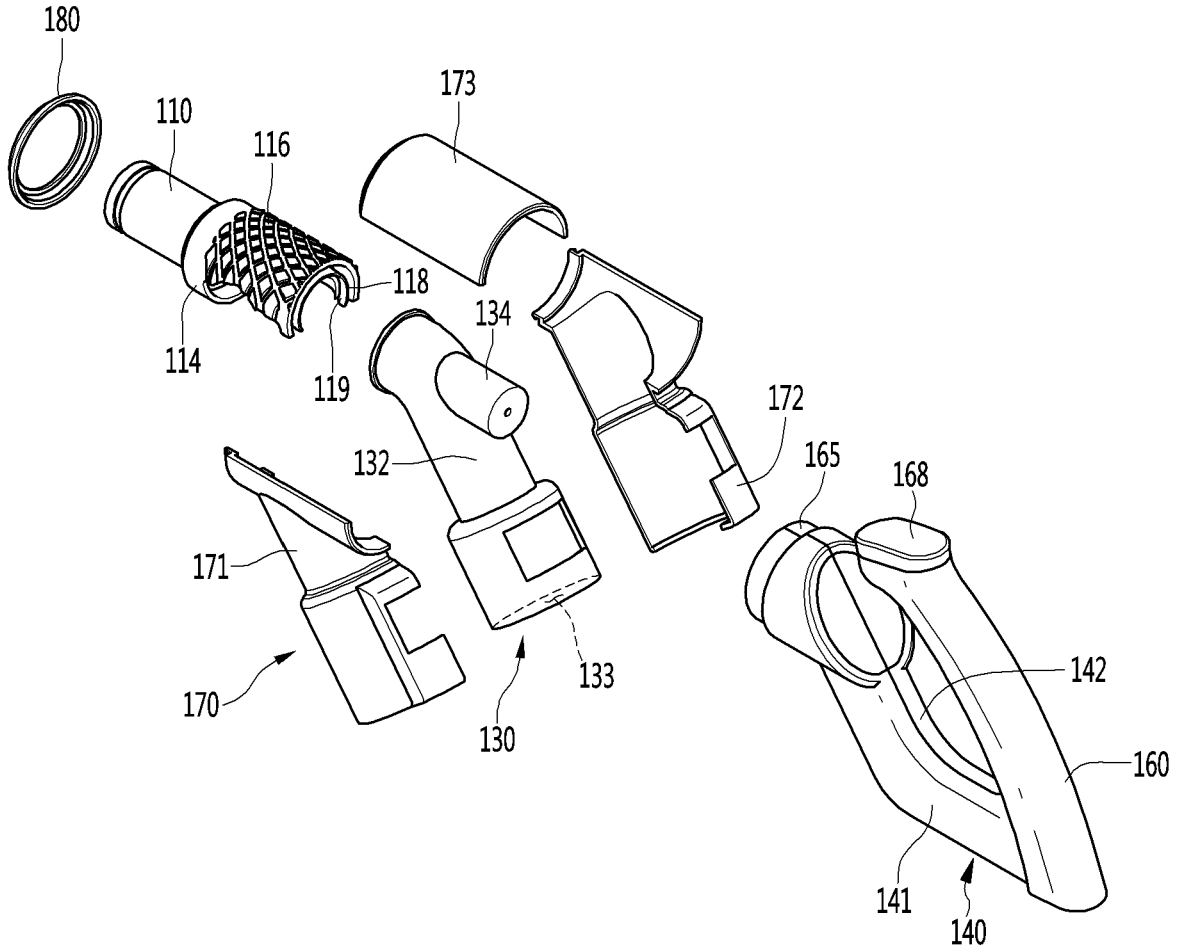
FIG. 3 is an exploded perspective view illustrating the handle of FIG. 2.
Figure 4:
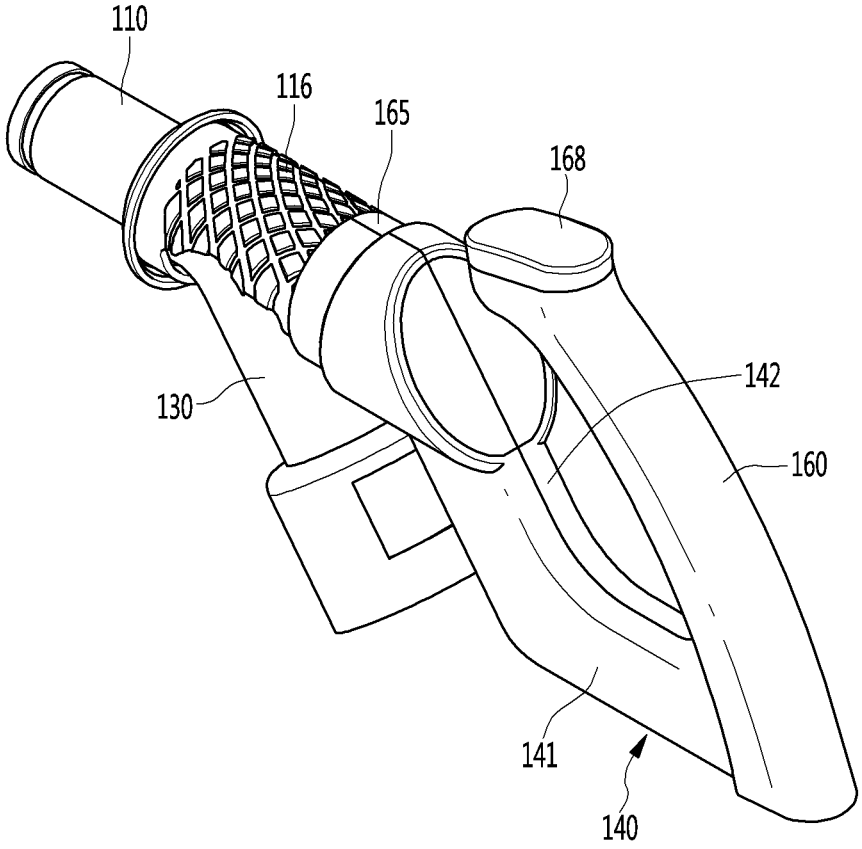
FIG. 4 illustrates a state in which a pipe cover is removed from the handle of FIG. 2.

Referring to FIG. 1, a vacuum cleaner 1 according to an embodiment of the present disclosure may include a cleaner body 10 and a suction device 20 that is connected to the cleaner body 10. The suction device 20 may include a suction part (or suction head) 21 to suck dust on a surface to be cleaned, for example, a floor surface, and connection parts 22, 23 and 24 to connect the suction part 21 to the cleaner body 10.

The connection parts 22, 23 and 24 may include an extension tube 24 that is connected to the suction part 21, a handle 100 that is connected to the extension tube 24 and a suction hose 23 that connects the handle 100 to the body 10. When a user moves or rotates the handle 100 in a front-rear direction or a left-right direction while holding the handle 100, a moving force of the handle 100 is transferred to the suction part 21 so that the suction part 21 may be moved with respect to the bottom surface.

The vacuum cleaner 1 may further include a dust separating part that separates air and dust that are sucked through the suction device 20 from each other and a dust container 30 that stores the dust that has been separated from the dust separating part. The dust container 30 may be separably mounted on the cleaner body 10. The dust separating part may be manufactured as a product that is separate from the dust container 30 or may constitute one module with the dust container 30.

Referring to FIGS. 2 to 5, a handle 100 according to an embodiment of the present disclosure may be connected to the extension tube 24 to transfer air and dust to the suction hose 23. The handle 100 may include an air passage 133 through which the air and the dust flow. Further, the handle 100 may include a grip part (or grip) 147 that is to be held by the user. To improve a grip feeling of the user, the handle 100 may further include a grip cover 160 that surrounds the grip part 147 and is formed of rubber.

The handle 100 may include an extension tube connector 110 that is connected to the extension tube 24, an air flow pipe 130 through which the air and the dust that are introduced from the extension tube 24 flow, and a handle body 140 that is to be held by the user. The extension tube connector 110 may include an air inlet 112. The extension tube 24 may be connected to the air inlet 112.

The extension tube connector 110 may further include a pipe connector 114 to which the air flow pipe 130 is connected. The air flow pipe 130 may be connected to the pipe connector 114. As an example, one end of the air flow pipe 130 may be inserted into the pipe connector 114.

The extension tube connector 110 may further include a first connector 116 that is to be connected to the handle body 140. As an example, the first connector 116 may extend from the pipe connector 114 toward the handle body 140.

A first fastening part (or female joint) 118 may be provided at the first connector 116, and the first fastening part 118 may surround a portion of the air flow pipe 130. The air flow pipe 130 may communicate with the suction hose 23. The air flow pipe 130 may include a pipe body 132 that defines the air passage 133 to transfer the air and the dust that are introduced from the extension tube connector 110 to the suction hose 23.

The suction hose 23 may be connected to the air flow pipe 130 directly or through a separate connection member.

Further, the suction hose 23 may communicate with the air flow pipe 130 while being coupled to a pipe cover 170 which will be described below.

A central line of the air flow pipe 130 may be a curved line. Thus, the air flow pipe 130 may guide the air and the dust that are introduced from the extension tube connector 110 to the suction hose 23 while a flow direction thereof is changed.

A body coupling part (or body coupler) 134 may be provided in the air flow pipe 130. As an example, the handle body 140 may be rotatably connected to and may be fixed to the body coupling part 134. The body coupling part 134 may protrude from an outer surface of the pipe body 132.

When the air flow pipe 130 is connected to the extension tube connector 110, an extension direction of the body coupling part 134 may be parallel or identical to the extension direction of a central line C of the extension tube connector 110. The body coupling part 134 may have a cylindrical shape and a portion thereof may be inserted into the handle body 140.

The first fastening part 118 may surround the body coupling part 134. A rounded groove 119 may be formed in the first fastening part 118 such that an interference between the first fastening part 118 and the body coupling part 134 is prevented.

The handle body 140 may be formed by coupling a plurality of members. As an example, the handle body 140 may include a first handle body 141 and a second handle body 143 that is coupled to the first handle body 141. Although not restricted, the handle body 140 may be formed by coupling three or more bodies.

The first handle body 141 and the second handle body 142 may be fastened to each other through a fastening member such as a screw. When the first handle body 141 and the second handle body 142 are coupled to each other, the handle body 140 may define second connectors 143 and 144 that are connected to the air flow pipe 130, the grip part 147 that is to be held by the user, and third connectors 145 and 146 that connect the second connectors 143 and 144 to the grip part 147.

The first handle body 141 may include a first grip body 148*a* that defines a first portion of the grip part 147 and the second handle body 142 may include a second grip body 148*b* that defines a second portion of the grip part 147. Further, one grip part 147 may be completely formed by coupling the first grip body 148*a* and the second grip body 148*b* to each other.

The second connectors 143 and 144 may be connected to the first connector 116. To achieve this, a second fastening part (or male joint) 165 may be provided jointly at the second connectors 143 and 144. The second fastening part 165 may be fastened to the first fastening part 118 of the first connector 116 through a fastening member such as a screw and a hook.

To fasten the first handle body 141 and the second handle body 142 to each other, a fastening boss 153 to which the fastening member is fastened may be formed in any one of the first handle body 141 and the second handle body 142 and an accommodation groove 154 in which the fastening member that is to be fastened to the fastening boss 153 is accommodated is formed in the other one thereof. Although not restricted, at least one fastening boss 153 and at least one accommodation groove 154 may be provided in the grip part 147. Of course, the fastening boss 153 and the accommodation groove 154 may be additionally provided in one or more of the second connectors 143 and 144 and the third connectors 145 and 146.

As described above, to improve a grip feeling, the grip cover 160 may surround the grip part 147. In a state in which the respective grip bodies 148*a* and 148*b* of the first handle body 141 and the second handle body 142 are fastened to each other through fastening members, the grip cover 160 may be integrally with the grip part 147 through insert-injection molding In a state in which the first handle body 141 and the second handle body 142 are fastened to each other, because the first grip part 160 surrounds the grip bodies 148*a* and 148*b* through the insert-injection molding, a boundary part or connection part between the grip bodies 148*a* and 148*b* may be prevented from being exposed to the outside in the first handle body 141 and the second handle body 142. Further, in a state in which the first handle body 141 and the second handle body 142 are fastened to each other, the grip cover 160 may surround the grip part 147 through insert-injection molding, so that a gap may not be generated in the grip cover 160 and working processes may be reduced. The gap may be prevented from being generated at a portion that corresponds to the boundary part between the grip bodies 148*a* and 148*b* in the grip cover 160.

In the present embodiment, in a state in which the grip cover 160 is insert-injection-molded to surround the grip part 147, when an adhesive force between the grip cover 160 and the grip part 147 deteriorates, the grip cover 160 may be separated from the grip part 147 so that the grip cover 160 is rotated with respect to the grip part 147.

Thus, in the present disclosure, the handle body 140 may include first anti-rotation grooves 150 such that the grip cover 160 is prevented from being rotated with respect to the grip part 147. The first anti-rotation grooves 150 may be provided in one or more of the first grip body 148*a* and the second grip body 148*b*. Each first anti-rotation groove 150 may include a first groove 151 and a second groove 152 that extends from the first groove 151 toward an inside of the grip part 147 and may have a width or diameter that is larger than that of the first groove 151.

When the grip cover 160 is insert-injection-molded to surround the grip part 147, a portion of the grip cover 160 may be located inside the first groove 151 and the second groove 152. As the width or diameter of the second groove 152 is formed to be larger than the width or diameter of the first groove 151, a portion of the grip cover 160 that is located in the second groove 152 may be prevented from being separated from the second groove 152 even when an external force is applied to the grip cover 160, and accordingly the grip cover 160 may be prevented from being rotated with respect to the grip part 147.

As the at least one fastening boss 153 and the at least one accommodation groove 154 are provided in the grip part 147, a portion of the grip cover 160 may be located within the accommodation groove 154 when the grip cover 160 is insert-injection-molded to surround the grip part 147. Thus, even when an external force is applied to the grip cover 160, the grip cover 160 may be restrained from being rotated as a portion of the grip cover 160 that is located in the accommodation groove 154 acts as resistance.

While the grip cover 160 is insert-injection-molded to surround the first and second grip bodies 148*a* and 148*b* together in a state in which the first grip body 148*a* and the second grip body 148*b* are coupled to each other, reinforcement ribs 155 may be provided in one or more of the first grip body 148*a* and the second grip body 148*b* such that the respective grip bodies 148*a* and 148*b* may be prevented from being deformed. Although not restricted, the reinforcement ribs 155 may be arranged in the grip bodies 148*a* and 148*b* to have a polygonal shape.

The grip part 147 may include a manipulation part (or button) 168 through which an operation command of the cleaner body 30 is input. As an example, the manipulation part 168 may be arranged above the grip part 147.

The handle 100 may further include the pipe cover 170 to cover the air flow pipe 130. The pipe cover 170 may additionally cover the first connector 116 of the extension tube connector 110 and a portion of the handle body 140.

The pipe cover 170 may be completely formed by coupling a plurality of members. Although not restricted, the pipe cover 170 may include a first pipe cover 171, a second pipe cover 172 and a third pipe cover 173. The first pipe cover 171 and the second pipe cover 172 may be coupled to each other in a horizontal direction, and the third pipe cover 173 may connect the first pipe cover 171 and the second pipe cover 172. The third pipe cover 173 may cover an outside of the first connector 116.

The first connector 116 may be located between the third pipe cover 173 and the air flow pipe 130. Further, the first to third pipe covers 171 to 173 may be fastened to each other through a connector ring 180.

Figure 5:
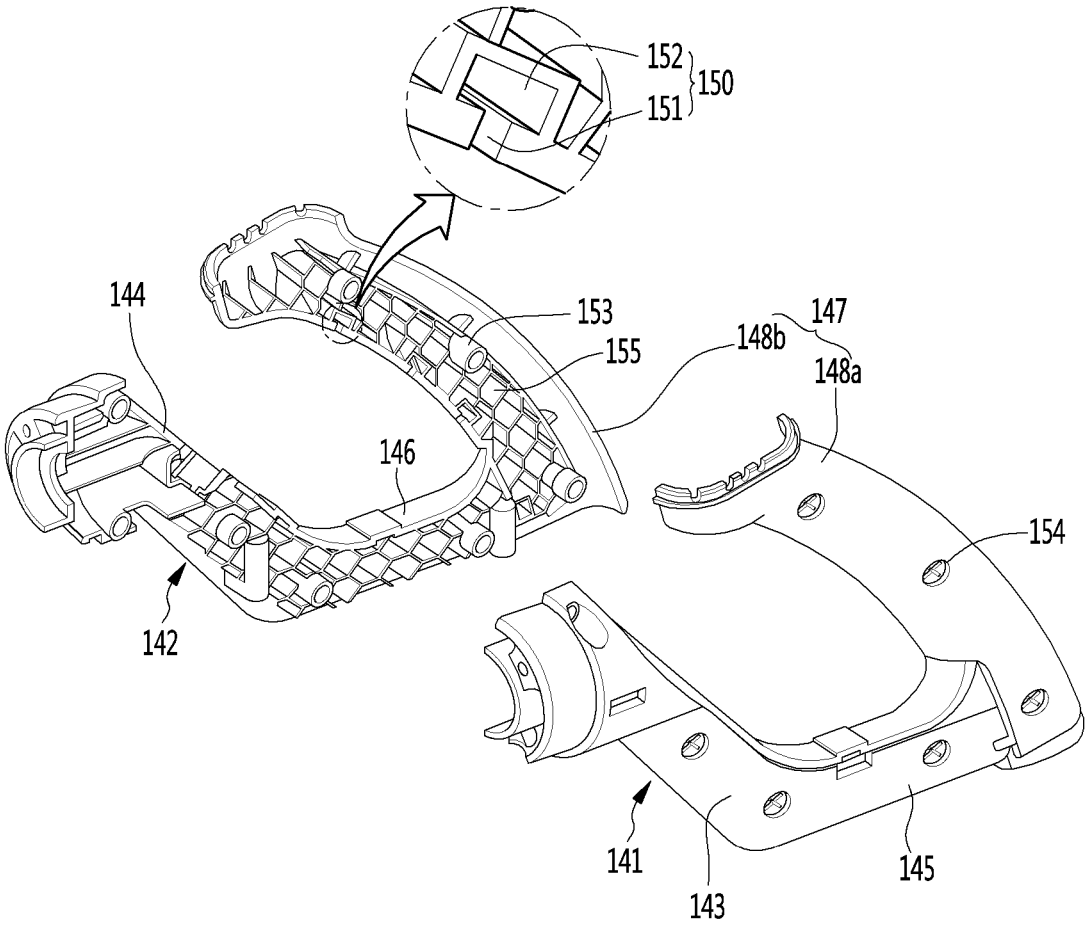
FIG. 5 is an exploded perspective view illustrating a handle body according to the embodiment of the present disclosure.
Figure 6:
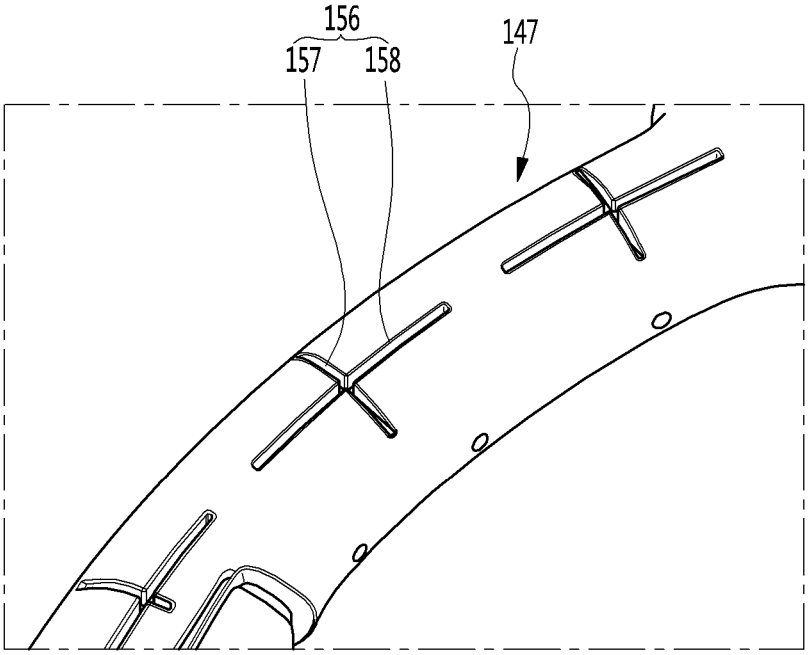
FIG. 6 illustrates a grip part of the handle body according to the embodiment of the present disclosure.
Figure 7:
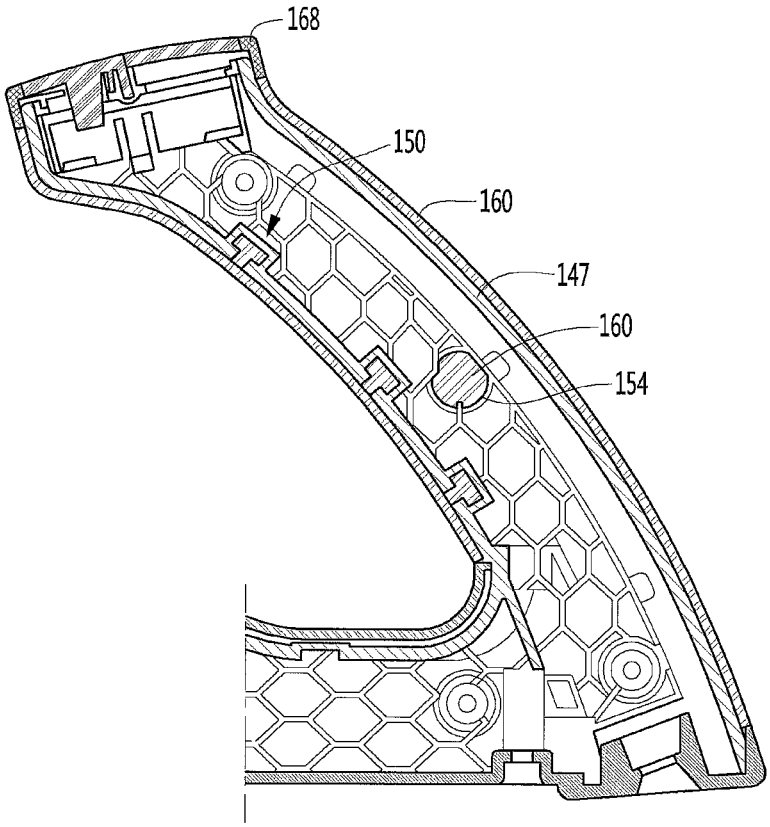
FIG. 7 is a sectional view illustrating the grip part of the handle body according to the embodiment of the present disclosure.

Referring to FIGS. 5 to 7, the handle body 140 may further include second anti-rotation grooves 156 such that the grip cover 160 is prevented from being rotated with respect to the grip part 147. The second anti-rotation grooves 156 may be provided in one or more of the first grip body 148*a* and the second grip body 148*b*.

Each second anti-rotation groove 156 may include a first extension groove 157 that extends from the grip bodies 148*a* and 148*b* in a first direction and a second extension groove 158 that extends in a second direction that is perpendicular to the first extension groove 157. Although not restricted, the first extension groove 157 and the second extension groove 158 may have a cross shape.

Further, any one of the first extension groove 157 and the second extension groove 158 may extend in a direction that is substantially parallel to a lengthwise direction (extension direction) of the grip part 147. The other one of the first extension groove 157 and the second extension groove 158 may extend in a direction that is perpendicular to the lengthwise direction of the grip part 147.

By the second anti-rotation grooves 156, even when an external force is applied to the grip cover 160, the grip cover 160 may be prevented from being rotated with respect to the grip part 147. According to the proposed present embodiment, because the grip cover that is formed of rubber is arranged to surround the grip part, a grip feeling may be improved, and because hands of the user come into contact with the grip cover that is formed of rubber, a friction force between the hands of the user and the grip cover may be increased, so that the user may be prevented from missing the grip part.

Further, even when an external force is applied to the grip cover in a state in which the grip cover is insert-injection-molded to surround the grip part, the grip cover may be prevented from being rotated with respect to the grip part, by the anti-rotation grooves. As the reinforcement ribs may be formed in the grip body, even when the grip cover is insert-injection-molded in a state in which the grip bodies are coupled to each other, the grip bodies may be prevented from being deformed during an injection molding process.

Figure 8:
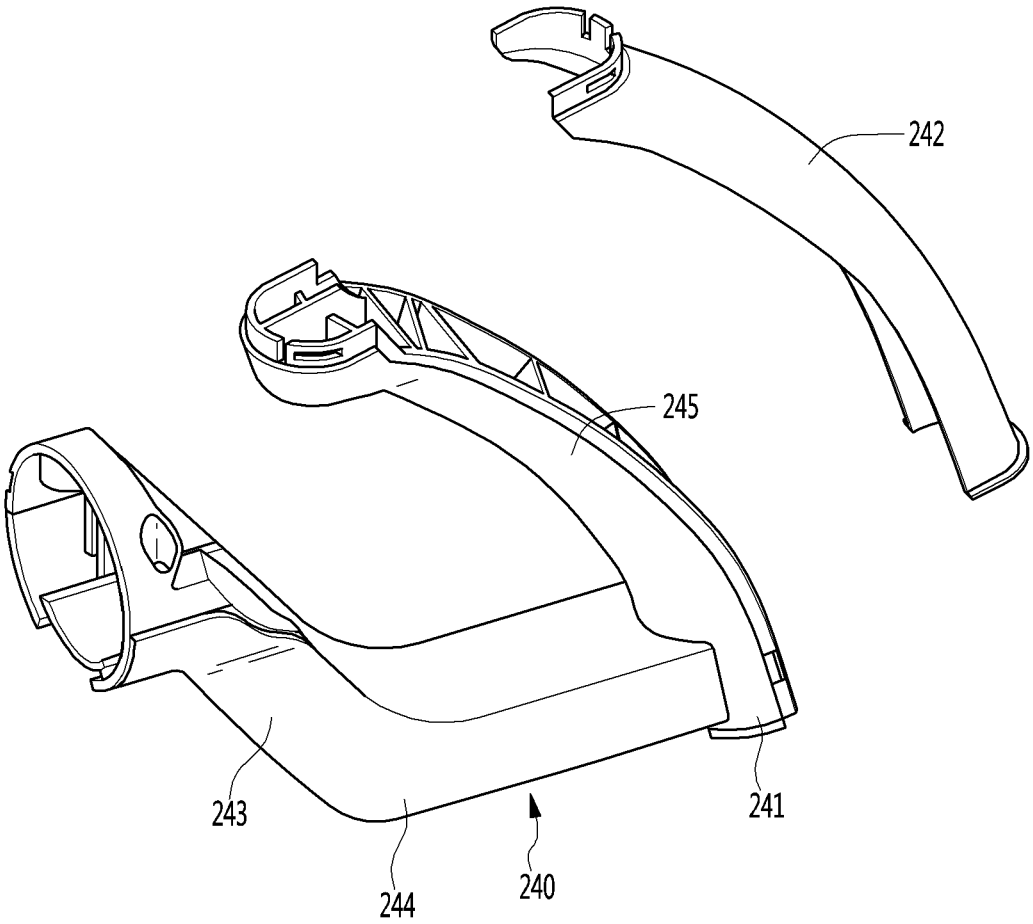
FIG. 8 is an exploded perspective view illustrating a handle body according to an embodiment of the present disclosure.
Figure 9:
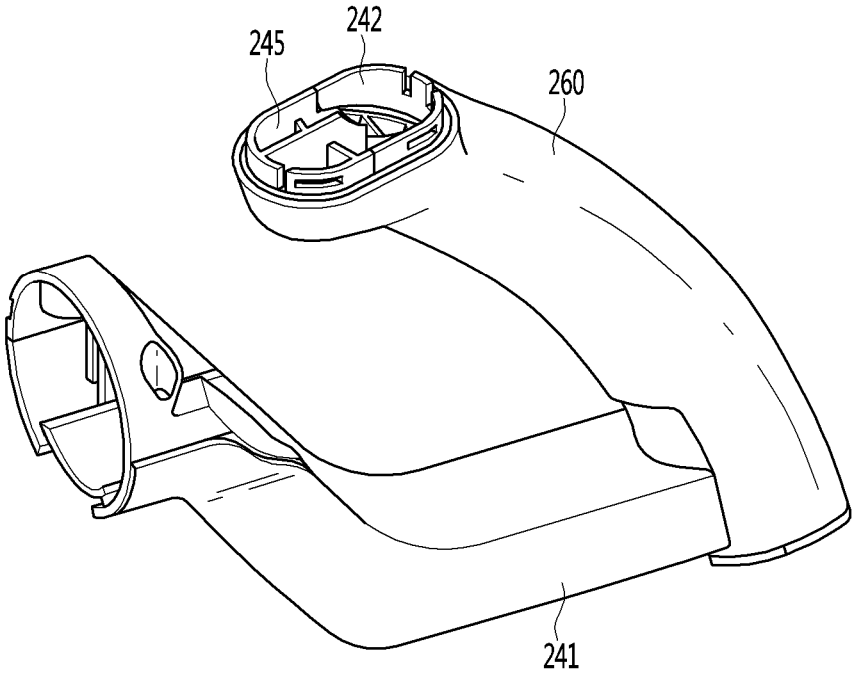
FIG. 9 illustratesa state in which a grip cover is provided in a grip part of a handle body according to an embodiment of the present disclosure.

Referring FIGS. 8 and 9, a handle body 240 according to another embodiment may include a first handle body 241 and a second handle body 242 that is coupled to the first handle body 241. The first handle body 241 may define the second connector 243 and the third connector 244, which have been described in the prior embodiments.

Further, the first handle body 241 may include a first grip body 245. The second handle body 242 may include a second grip body that is coupled to the first grip body 245. The second handle body 242 may include the second grip body. Further, one grip part may be formed by coupling the first grip body 245 and the second grip body to each other.

Even in the present embodiment, one or more of the first anti-rotation grooves and the second anti-rotation grooves, the reinforcement ribs, the fastening bosses and the accommodation grooves, which have been described in the prior embodiments, may be provided in one or more of the first grip body 245 and the second grip body. Further, in a state in which the grip part is formed by coupling the first grip body 245 and the second grip body to each other, the grip cover 260 may be insert-injection-molded to surround the grip part.

The above-mentioned structure of the handle is illustrative, and it is appreciated that the structure of the handle is not limited when the structure is a structure in which the grip cover is formed through insert-injection molding to surround two or more grip parts together. Further, although the handle for a canister cleaner has been described in the above embodiments as a device having an improved grip feeling, the present disclose may also be applied to handles for different types of cleaners such as an upright cleaner. Further, the present disclose may be applied to all devices such as a mobile phone and a wearable device, in addition to the cleaner, which may be used while the user holds the same.

Even in this case, the grip part that is to be held by the user or the case that defines the outer appearance of the device is configured by two or more bodies, and after the two or more bodies are coupled to each other, a cover (or the grip cover) that is formed of rubber may be insert-injection-molded to surround a portion or the entirety of the two or more bodies together. In addition, the anti-rotation grooves, the reinforcement ribs, the fastening member and the accommodation groove, which have been described above, may be implemented to have the same or similar form.

A handle for a cleaner according to an aspect of the present disclosure may include: two or more handle bodies that have grip bodies, respectively; and a grip cover that is formed of rubber and is insert-injection-molded to surround grip bodies that define a grip part in a state in which the respective grip bodies are connected to each other to define the one grip part, wherein the grip cover covers boundaries of the grip bodies. A device having an improved grip feeling according to another aspect may include: two or more bodies that define an outer appearance thereof; and a single cover that is formed of rubber and is insert-injection-molded to surround the two or more bodies together in a state in which the two or more bodies are connected to each other.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

The above description is merely illustrative description of the technical spirit of the present disclosure, and various modifications and deformations may be derived by those skilled in the art to which the present disclosure pertains without departing from the essential feature of the present disclosure. Thus, the embodiments that are disclosed in the present disclosure are not for limiting but for describing the technical spirit of the present disclosure, and the scope of the technical spirit of the present disclosure is not limited by the embodiments.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A handle for a cleaner, the handle comprising:

at least two handle bodies including at least two grip bodies that form a grip; and a single seamless grip cover formed of rubber and configured to surround an entire circumference of the at least two grip bodies that define the grip when the at least two grip bodies are connected to each other, wherein the grip includes at least one anti-rotation groove into which a first portion of the single grip cover is received to prevent the single grip cover from rotating with respect to the grip, wherein the single grip cover covers a joint between the at least two grip bodies, wherein a fastening boss is provided in a first handle body of the least two handle bodies, and an accommodation groove is provided in a second handle body of the least two handle bodies, wherein a fastener is received in the accommodation groove and coupled to the fastening boss to connect the first and second handle bodies, wherein a second portion of the single grip cover is received within the accommodation groove to prevent the single grip cover from rotating with respect to the grip, and wherein a portion of the handle that is not covered by the single grip cover is connected to a pipe cover that covers an air flow pipe to couple a hose from a cleaner body of the cleaner to a suction device.

2. The handle of claim 1, wherein the at least one anti-rotation groove includes a first groove and a second groove extending from the first groove toward an interior of the grip, the second groove being wider than the first groove.

3. The handle of claim 2, wherein the first portion of the single grip cover is located within the first groove and the second groove.

4. The handle of claim 2, wherein the at least one anti-rotation groove includes a first extension groove that extends from the grip in a first direction and a second extension groove that extends in a second direction perpendicular to the first direction, and wherein the first portion of the single grip cover is located within the first extension groove and the second extension groove.

5. The handle of claim 4, wherein the first direction or the second direction is identical to an extension direction of the grip.

6. The handle of claim 4, wherein the first extension groove and the second extension groove have a cross shape.

7. The handle of claim 1, wherein reinforcement ribs to prevent one or more of the at least two grip bodies from being deformed during an insert-injection molding process are provided in at least one of the at least two grip bodies.

8. The handle of claim 7, wherein each of the reinforcement ribs has a polygonal shape.

9. The handle of claim 1, wherein a button configured to receive an operation command of the cleaner body is provided at another portion of the handle that is not covered by the single grip cover.

10. The handle of claim 9, wherein the portion of the handle that is connected to the pipe cover is positioned at a first end of the handle, and the other portion of the handle where the button is provided is positioned at a second end of the handle.

11. The handle of claim 9, wherein the at least one anti-rotation groove is positioned between the portion of the handle that is connected to the pipe cover and the other portion of the handle where the button is provided is positioned.

12. The handle of claim 1, wherein the pipe cover is configured to cover the portion of the handle that is not covered by the single grip cover.

13. The handle of claim 1, wherein the air flow pipe includes a body coupling protrusion that is coupled to the portion of the handle that is not covered by the single grip cover.

14. The handle of claim 1, wherein the two grip bodies include respective connectors that are coupled to the air flow pipe.

15. The handle of claim 1, wherein the pipe cover includes a first pipe cover wall and a second pipe cover wall that are coupled together, and a third pipe cover wall connected to the first pipe cover wall and the second pipe cover wall to define a passage to receive at least a portion of the air flow pipe.

16. The handle of claim 15, wherein the pipe cover includes a connector ring that includes an opening to receive the first, second, and third pipe cover walls.

* * * * *